US007970300B2

(12) United States Patent
Tabata et al.

(10) Patent No.: US 7,970,300 B2
(45) Date of Patent: Jun. 28, 2011

(54) IMAGE FORMING APPARATUS HAVING TONER CHARGE AMOUNT CONTROL

(75) Inventors: Eiji Tabata, Ibaraki (JP); Masahiko Matsuura, Suita (JP); Keiko Momotani, Ibaraki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 884 days.

(21) Appl. No.: 11/975,953

(22) Filed: Oct. 23, 2007

(65) Prior Publication Data

US 2008/0101806 A1 May 1, 2008

(30) Foreign Application Priority Data

Oct. 27, 2006 (JP) ..... 2006-292372

(51) Int. Cl.
*G03G 15/00* (2006.01)

(52) U.S. Cl. ..... 399/45; 399/53; 399/66

(58) Field of Classification Search ..... 399/45, 399/53, 66

See application file for complete search history.

(56) References Cited

U.S. PATENT DOCUMENTS 6,115,576 A 9/2000 Nakano et al.
6,397,020 B1 * 5/2002 Kim ..... 399/45
6,766,123 B2 7/2004 Ebihara et al.
6,775,507 B2 * 8/2004 Matsuura et al. ..... 399/297
2004/0005407 A1 * 1/2004 Takeuchi et al. ..... 427/240
2004/0175208 A1 * 9/2004 Ichida et al. ..... 399/302
2006/0051138 A1 * 3/2006 Sato et al. ..... 399/296
2008/0069579 A1 * 3/2008 Tabata et al. ..... 399/53

FOREIGN PATENT DOCUMENTS

JP 09-304979 11/1997
JP 2005234430 A * 9/2005

OTHER PUBLICATIONS

JP 2005234430, cited above, Sep. 2005.*
English Abstract of JP 2005234430, Sep. 2005.*

* cited by examiner

*Primary Examiner* — David P Porta
*Assistant Examiner* — Bryan P Ready
(74) *Attorney, Agent, or Firm* — Brinks Hofer Gilson & Lione

(57) ABSTRACT

An image forming apparatus including a toner charge amount control portion for controlling the toner charge amount based on the property of a recording material; a recording material charging section for charging the surface of the recording material based on the toner charge amount controlled by the aforementioned toner charge amount control portion; and a recording media charge amount control portion for controlling the amount of charge on the surface of a recording material applied by the recording material charging section.

12 Claims, 3 Drawing Sheets

IMAGE FORMING APPARATUS HAVING TONER CHARGE AMOUNT CONTROL

This application is based on Japanese Patent Application No. 2006-292372 filed on Oct. 27, 2006, in Japanese Patent Office, the entire content of which is hereby incorporated by reference.

TECHNICAL FIELD

The present invention relates to an image forming apparatus for developing an electrostatic latent image on an image supporting member by a liquid developer and transferring a formed toner image onto a recording material.

BACKGROUND

Conventionally, an image forming apparatus for developing an electrostatic latent image on the surface of an image supporting member with a liquid developer including toner particles dispersed in an insulating carrier liquid, transferring a toner image formed by development onto a recording material, thereby obtaining a final image is known. Further, an image forming apparatus for transferring primarily a toner image formed on an image supporting member by development with a liquid developer onto an intermediate transfer medium, superimposing toner images of a plurality of colors on the surface of the intermediate transfer material, thereafter transferring the superimposed toner images onto a recording material in a batch, thereby obtaining a final color image is known.

A wet type image forming apparatus using a liquid developing device has advantages which cannot be realized by a dry type image forming apparatus, and in recent years, the value has been reconsidered. The main advantage of the wet type image forming apparatus is that very fine toner of a submicron size can be used, so a high image quality can be realized, and a texture equivalent to printing can be obtained. Particularly, in recent years, in correspondence to speed-up of the image forming apparatus, there has been a trend to use a liquid developer including toner particles dispersed in high concentration in a carrier liquid of high viscosity.

For transfer of a toner image from an image supporting member or an intermediate transfer medium to a recording material in the wet type image forming apparatus, generally, an electrostatic transfer system by electrostatic force is used. Toner particles are charged, so when a voltage with the reverse polarity to the charging polarity of the toner particles is impressed to the transfer roller installed on the rear side of the recording material, the toner particles move to the surface of the recording material by the electrostatic force.

In such an image forming apparatus, to output an image of a high quality regardless of the kind of a recording material used, it is necessary to execute transfer to the recording material stably and highly efficiently.

Japanese Laid-Open Patent Publication H9-304979 discloses the image forming apparatus for controlling, depending on the characteristics of transfer sheets, the toner adhesion amount (the potential of the photoconductor, developing bias voltage), bias voltage to the set roller for stabilizing the toner adhesion condition on the photoconductor, charging current to the photoconductor, transfer current, and fixing temperature. However, the art recorded in this document does not adjust the charging quantity given to toner depending on the property of the recording material, so an image of a sufficiently high quality cannot be outputted.

Further, U.S. Pat. No. 6,115,576 discloses the image forming apparatus for giving a charge of the same polarity as that of toner to a toner image on an intermediate transfer belt. However, the art recorded in this document does not carry out control depending on the property of the recording material, so the transfer efficiency of toner onto the recording material may be deteriorated extremely.

Further, U.S. Pat. No. 6,766,123 discloses the dry type image forming apparatus which has a pre-transfer charging roller, prior to transfer of a toner image, for charging the surface of a recording material with reverse polarity to the charging polarity of the toner and changes a voltage impressed to the charging roller depending on the kind of the recording material. However, the art recorded in this document does not adjust the charging quantity of toner depending on the property of the recording material either, thereby cannot accomplish an object of outputting an image of a sufficiently high quality.

SUMMARY

The present invention was developed with the foregoing in view, and an object of the present invention is to provide an image forming apparatus capable of obtaining an image of a high quality regardless of the kind of a recording material.

Further, another object of the present invention is to provide an image forming apparatus capable of transferring highly efficiently a toner image including an appropriate amount of toner to a recording material depending on the property of the recording material and obtaining an image of a high quality.

In view of forgoing, one embodiment according to one aspect of the present invention is an image forming apparatus, comprising:

an image supporting member;

an image forming mechanism which is adapted to form an electrostatic latent image on the image supporting member;

a development section which is adapted to develop the electrostatic latent image formed on the image supporting member with a liquid developer including toner so as to form a toner image;

a transferring section which is adapted to transfer the toner image formed by the development section onto a recording material;

an input portion which is adapted to input a property of the recording material;

a toner charge amount control portion which is adapted to control an amount of a charge of the toner depending on the property of the recording material inputted by the input portion;

a recording material charging section which is adapted to apply a charge to a surface of the recording material; and a recording material charge amount control portion which is adapted to control an amount of the charge to be applied to the recording material by the recording material charging section depending on the amount of the charge of the toner controlled by the toner charge amount control portion.

According to another aspect of the present invention, another embodiment is a method of forming an image, comprising the steps of:

forming an electrostatic latent image on an image supporting member;

forming a toner image by developing the electrostatic latent image formed on the image supporting member with a liquid developer;

transferring the toner image onto a recording material;

judging a property of the recording material;

applying to the toner image, between a developing position defined by a development section and a transferring position defined by a transferring section, a charge opposite to a charge polarity of the toner image; and controlling the charge to be applied to the toner and a charge to be applied to the recording material, before transferring the toner image, depending on the judged property of the recording material.

DETAILED DESCRIPTION OF THE PREFERRED EMBODIMENT

Figure 1:
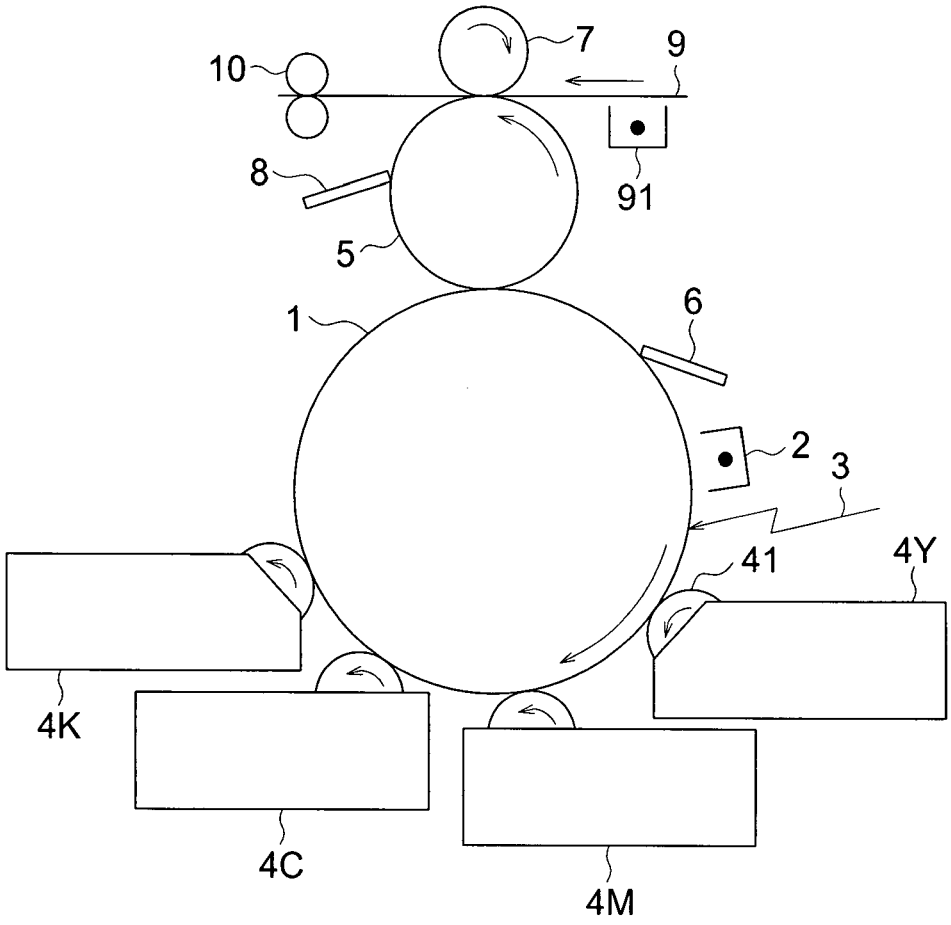
FIG. 1 is a diagram representing the schematic structure of the image forming apparatus as an embodiment of the present invention.

The following describes the embodiment of the present invention with reference to drawings:

FIG. 1 is a diagram representing the schematic structure of the image forming apparatus as an embodiment of the present invention. A charger 2, exposure device 3, liquid developing devices 4Y, 4M, 4C and 4K, intermediate transfer member (intermediate transfer member) 5, photoconductor cleaning device 6 are arranged around the photoconductor 1 as an electrostatic latent image supporting member in the direction of rotation indicated by arrows. A transfer roller 7, and intermediate transfer member cleaning device 8 are arranged around the intermediate transfer member 5. Four liquid developing devices 4Y, 4M, 4C and 4K are provided removably from the aforementioned photoconductor 1.

Figure 2:
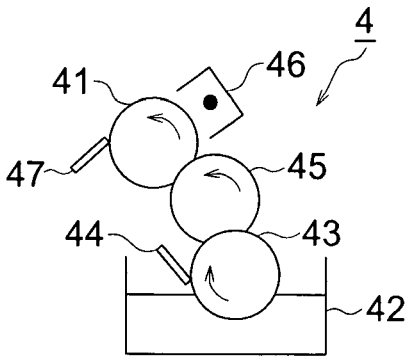
FIG. 2 is a diagram representing the schematic structure of a liquid developing device according to the embodiment of the present invention.

FIG. 2 is a schematic structure of the liquid developing device 4 used as liquid developing devices 4Y, 4M, 4C and 4K in FIG. 1. The liquid developing device 4 contains a liquid developer container 42, pump-up roller 43, pump-up volume regulating section 44, regulating roller 45, and a developer supporting member such as a development roller 41 for developing the electrostatic latent image on the surface of the photoconductor 1 with the liquid developer. It also includes a toner charging section 46 for applying a charge to the toner on the development roller and a development roller cleaning section 47 for removing the remaining developer from the development roller 41 subsequent to development of the electrostatic latent image on the surface of the photoconductor 1.

The toner images of the each color corresponding to each liquid developing device are formed with the toner of the liquid developing device 4Y being a yellow toner, the toner of the liquid developing device 4M being a magenta toner, the toner of the liquid developing device 4C being a cyan toner, and the toner of the liquid developing device 4K being a black toner. They are superimposed on the surface of the intermediate transfer member 5, and are collectively transferred to the recording material 9, whereby a full-color image is formed.

Before the toner images are transferred from the intermediate transfer member 5, the amount of charge applied on the surface of the recording material 9 is adjusted by a recording material charging section such as a recording material charging section 91 that applies a charge to the surface of the recording material 9.

The following describes the operation of the image forming apparatus in FIG. 1. The photoconductor 1 rotates in the direction indicated by the arrow. The surface of the photoconductor 1 is uniformly charged by the charger 2 to a predetermined surface potential. After that, image information is exposed by the exposure device 3, and an electrostatic latent image is formed on the surface of the photoconductor 1. Then the liquid developing device 4Y is positioned opposite to the photoconductor 1. The liquid developer carried on the surface of the development roller 41 is brought into contact with the photoconductor 1, and the electrostatic latent image is developed, whereby a yellow toner image is formed on the surface of the photoconductor 1.

The liquid developer used in the liquid developing device 4 is produced by dispersing toner particles in an insulating carrier solution. It is possible to further add a functionalizing agent such as a charge control agent and dispersant. There is no particular restriction to the density and viscosity of the liquid developer. It is preferred that the solid components of toner particles should be dispersed at a ratio of 10 through 50% by mass, and a high-viscosity liquid developer should be used at high density wherein the viscosity at 25° C. is in the range of 0.01 through 10 Pa·s. A charge of positive polarity is given to the toner particles by the toner charging section 46.

Figure 3:
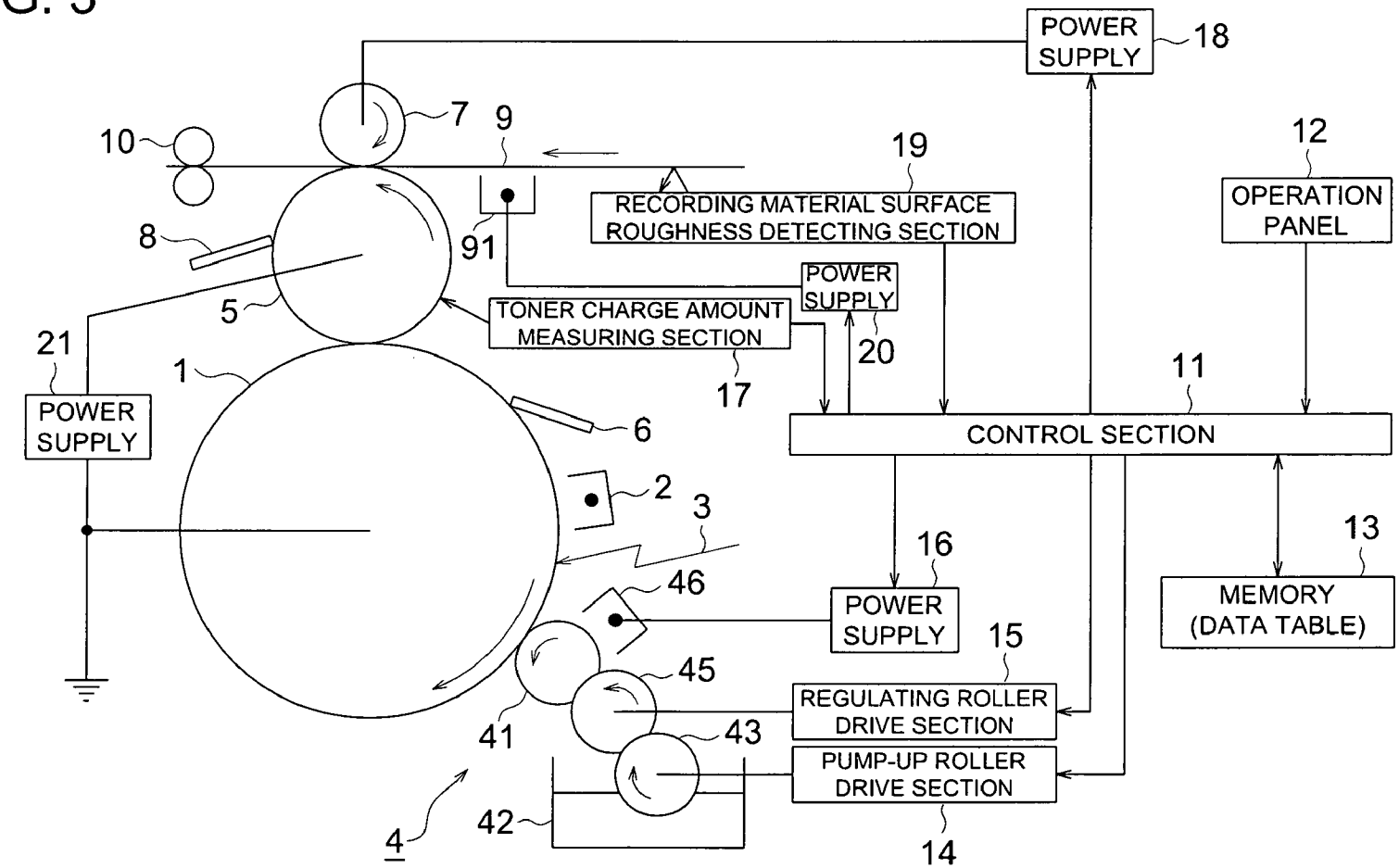
FIG. 3 is a diagram showing an example of the functional structure for the control of an image forming apparatus as an embodiment of the present invention.

In response to the rotation of the photoconductor 1, the toner image on the surface goes to the primary transfer region where the photoconductor 1 and intermediate transfer member 5 contact each other. A negative bias is applied to the intermediate transfer member 5 by the power supply 21 (FIG. 3). Toner is moved by the electric field generated by this bias, whereby the toner image on the surface of the photoconductor 1 is primarily transferred to the surface of the intermediate transfer member 5. After primary transfer, the liquid developer remaining on the photoconductor 1 is removed by the photoconductor cleaning device 6, and the surface of the photoconductor 1 is again charged uniformly to the predetermined surface potential by the charger 2. It should be noted that the intermediate transfer member 5 can be either drum-like or belt-like.

This is followed by the step of the electrostatic latent image being formed again on the surface of the photoconductor 1. The image is developed by the liquid developing device 4M, and a toner image of the magenta is formed on the surface of the photoconductor 1. The magenta toner image is primarily transferred onto the surface of the intermediate transfer member 5, and the yellow toner image and magenta toner image are superimposed on the surface of the intermediate transfer member 5. Similarly, the cyan toner image developed by the liquid developing device 4C and the black toner image developed by the liquid developing device 4K are also superimposed, and a full-color toner image is formed on the surface of the intermediate transfer member 5.

The full-color toner image formed on the surface of the intermediate transfer member 5 is fed to the secondary transfer region by the rotation of the intermediate transfer member 5 in the direction indicated by the arrow, the transfer region where the intermediate transfer member 5 and recording material 9 contact each other. In the secondary transfer region, a linear pressure is applied between the intermediate transfer member 5 and recording material 9 by the transfer roller 7 located on the rear surface of the recording material 9.

This linear pressure puts the toner image on the intermediate transfer member 5 in close contact with the recording material 9. Further, a negative bias is applied to the transfer roller 7. This allows a charge negative to the toner to be supplied to the surface of the recording material 9. The surface of recording material 9 entering the secondary transfer region is provided with charge in the amount adjusted in advance by recording material charging section 91.

The toner on the intermediate transfer member 5 is held on the recording material 9 by being bonded with the negative charge on the surface of the transferred member 9. Under this condition, the recording material 9 is conveyed in the arrow-marked direction to come out of the secondary transfer region. This completes the secondary transfer of the toner image onto the recording material 9. The recording material 9 to which the toner image has been transferred is subjected to the processing of fixing by the fixing device 10. This shows completion of image outputting.

In the image forming apparatus of the present invention, the amount of toner deposited on the recording material 9 is adjusted depending on the properties of the recording material 9. This is due to the following reasons: To output the image with the solid portion having uniform density, it is necessary to deposit sufficient amount of toner to completely cover the surface of the recording material 9 with rough surface structure. As the surface roughness of the recording material 9 is greater, the greater amount of toner must be deposited. In the meantime, in order to reduce the amount of toner to be used and to minimize the load on the printing cost and environment, the amount of toner to be deposited is preferred to be small as possible. Thus, depending on the surface roughness of the recording material 9, the amount of toner to be deposited is preferably adjusted to be necessary and sufficient to cover the surface. For example, for the paper of small surface roughness such as coated paper, the amount of toner deposited must be comparatively reduced. For the paper of great surface roughness such as non-coated paper, the amount of toner must be comparatively increased. To adjust the amount of toner deposited, it is necessary to adjust the amount of the developer to be conveyed. For example, it is possible to increase the ratio θ of the rotational speed of the regulating roller 45 and pump-up roller 43 to that of the development roller 41 of the liquid developing device 4, whereby the amount of the developer carried on the development roller 41 is increased.

However, if the amount of developer conveyed on the development roller 41 is increased with other conditions kept unchanged, the toner charge amount (charge amount Q/M of toner per unit mass) will be reduced. If the Q/M is too small, deposition of toner on the background of the image (fogging) will occur at the time of development in some cases. To avoid this, the output of the toner charging section 46 in the development apparatus 4 is adjusted, whereby the Q/M can be maintained even when the amount of toner has been increased.

In the meantime, when the amount of toner has been increased depending on the recording material having greater surface roughness, if an attempt is made to adjust the Q/M to the same level wherein the amount of toner is small, the charge amount Q/S of the toner image per unit area prior to transfer becomes greater than that when the amount of toner is smaller. As previously described, when bias is applied to the transfer roller 7, toner and negative charge are supplied to the surface of the recording material 9. The negative charge and toner are combined with each other, and toner is held on the recording material, whereby toner can be transferred. If the charge amount Q/S of the toner image per unit area prior to transfer is increased to exceed the charge amount opposite and equivalent to the charge of the toner to be supplied to the surface of the recording material 9, transfer efficiency will be reduced. The charge amount opposite and equivalent to the charge of the toner to be supplied to the recording material 9 is determined by the current value supplied to the transfer roller 7.

Thus, with the increase in Q/S, the current supplied to the transfer roller 7 is preferably increased. However, there is an upper limit to the amount of current to be practically supplied. This upper limit is determined by each roller, recording material and developer resistance value. If a current in excess of the upper limit is applied, discharge or leakage at the transfer nip will occur prior to transfer, with the result that transfer efficiency is reduced. In a low-moisture environment in particular, there is an increase in the electrical resistance of the transfer roller 7 or recording material. This reduces the upper limit value of the current that can be supplied to the transfer roller 7.

To solve such problems, a recording material charging section 91 for applying a negative charge opposite to that of toner to the surface of the recording material 9 prior to transfer of the toner image. A commonly used charge applying section such as a corona charging device and roller charging device can be used as the recording material charging section 91. To supply a sufficient amount of negative charge to the surface of the recording material 9 depending on the charge amount Q/S per unit area of the toner image prior to transfer, if the charge amount is not sufficient by application of bias to the transfer roller 7, the shortage of charge is made up for by the recording material charging section 91. When the Q/S is sufficiently small, it is not necessary to apply charge to the surface of the recording material 9 by the recording material charging section 91. In this case, to avoid needless power consumption, the amount of charge to be applied is set to 0. Depending on the electric resistance of the recording material, charge will decrease during the time from application of charge to the surface of the recording material 9 to arrival at the secondary transfer section. Thus, the distance between the recording material charging section 91 and the secondary transfer section is preferably small as possible. Anticipating the amount of charge to decrease, the amount of charge to be applied is preferably set greater than the aforementioned shortage of amount.

Considering all the aforementioned factors involved, the amount of toner and the charge supplied to the toner is adjusted depending on the surface roughness of the recording material 9, and the amount of charge to be applied to the surface of the recording material 9 is controlled depending on the charge amount Q/S per unit area of the toner image prior to transfer, whereby high-quality image can be obtained regardless of the kind of the recording material 9.

The following describes the further details of the control method used in the image forming apparatus of the present embodiment:

FIG. 3 is an overall schematic view of an image forming apparatus similar to the case of FIG. 1. It shows the following functions as blocks, the functions being for adjustment of the amount of toner, control of charge applied to the toner, control of charge applied to the surface of the recording material 9, and control of the transfer current supplied to the transfer roller 7. For simplicity, only one developing device 4 is shown in the diagram.

The reference numeral 11 denotes a control section. It works as a toner amount control portion for controlling the amount of toner depending on the properties of the recording material 9; a toner charge amount control portion for adjusting the amount of the charge applied using the toner charging section 46 depending on the amount of toner controlled; a transfer current adjusting portion for controlling the transfer current flowing to the transfer roller 7 depending on the amount of toner charge amount prior to transfer; and a recording material charge amount control portion for adjusting the amount of charge applied to the surface of the recording material 9.

The reference numeral 12 indicates an operation panel to be used by an operator to perform input operations required for the control by the control section 11. For example, it is used to specify the kind of the sheet as the property of the recording material 9. In this case, the operation panel 12 works as an input section.

The reference numeral 13 stores a data table and others. For example, the memory 13 stores the data table regarding the output for adjusting the amount of toner depending on the kind of paper and surface roughness, data on the amount of charge to be applied to toner depending on the amount of toner, or the relationship between the amount of toner or toner charge amount and adequate transfer current value.

The reference numeral 14 is a pump-up roller drive section. It controls the rotation of the pump-up roller 43, and adjusts the amount of the liquid developer to be pumped up from the liquid developer container 42. The reference numeral 15 is a regulating roller drive section. It adjusts the rotation of the regulating roller 45 to which a liquid developer is supplied from the pump-up roller 43, and controls the amount of the developer to be supplied to the development roller 41.

The reference numeral 16 is a toner charging power supply. It supplies voltage to the toner charging section 46 on the development roller 41, and applies adequate charge for development of the toner.

The reference numeral 17 is a toner charge amount measuring section. It measures the toner charge amount of the toner image on the intermediate transfer member 5, namely, the charge amount of the toner to be transferred to the recording material 9, and sends the measured value to the control section 11 so that it will be reflected to the transfer current in the transfer roller 7.

The reference numeral 18 is a transfer power supply. It is controlled by the control section 11 to apply voltage in such a way that the transfer current of adequate value in the transfer roller 7 will be given to the transfer roller.

The reference numeral 19 is a recording material surface roughness detecting section. It detects the surface roughness as the property of the recording material, and sends the detected value to the control section 11 to adjust the amount of toner. It works as an input section.

The reference numeral 20 is a power supply used for the recording material charging section 91. This power supply 20 is controlled by the control section 11.

Combined in the following manner, the aforementioned components operate to adjust the amount of toner, the toner charge amount, and the amount of charge to be applied to the surface of the recording material.

Based on the information on the kind of paper inputted by the operation panel 12 or the surface roughness information coming from the recording material surface roughness detecting section 19, the control section 11 refers to the data table in the memory 13, and determines the adequate output to the pump-up roller drive section 14, regulating roller drive section 15, power supply 16. These values are controlled to ensure that the amount of toner on the development roller 41 and the amount of toner charge will be adequate depending on the kind of the recording material 9 or the surface roughness.

If the amount of developer on the development roller 41 and the output of the toner charging section 46 are changed, there will be a change in the charge amount of the toner image on the intermediate transfer member 5 prior to transfer. When the charge amount of the toner image prior to transfer is too large and the current required to transfer all the toner images cannot be supplied sufficiently from the transfer roller 7, it is necessary to increase the current or voltage to be supplied to the recording material charging section 91 for applying charge to the surface of the recording material 9. The recording material charging section 91 can be controlled by the control section 11 based on the result of detection by the toner charge amount measuring section 17 that detects the charge amount of the toner image on the intermediate transfer member 5 per unit area using a surface potentiometer.

Control is possible without using a toner charge amount measuring section such as a surface potentiometer. This is because, if the amount of developer on the development roller 41 or the output of the toner charging section 46 is determined, the charge amount of the toner image on the intermediate transfer member 5 per unit area is roughly determined. In this case, for each of the amount of developer on the development roller 41 (the amount of developer is determined by the drive rotating speed of each roller) and the output conditions of the toner charging section 46, the transfer roller 7 capable of ensuring 100% transfer, and the conditions for the current (voltage) supplied to the recording material charging section 91 are checked in advance. Their relationship is stored as a data table in a memory 13, and each current (voltage) value is controlled by reference to this table.

When a toner charge applying section (including the toner discharging section) on the photoconductor 1 or intermediate transfer member 5 is independently arranged or is added, the outputs of the charge applying section thereof are also included in the data table so as to provide an integral control. Further, the current having actually flowed in the primary transfer from the photoconductor 1 to the intermediate transfer member 5 has a value corresponding to the charge amount of the toner image. This current is measured and the output of the recording material charging section 91 can be controlled based on the result of this measurement.

The aforementioned control method provides a high-quality image regardless of the kind of the recording material. Further, when selecting a mode capable of reducing the amount of toner used by to the user's instruction, adjustment is made so that the amount of toner will be reduced upon selection of this mode. At the same time, when the amount of charge applied to the toner is adjusted, and the current (voltage) supplied to the transfer roller 7 or the current (voltage) supplied to the recording material charging section 91 is controlled based on the charge amount of the toner image prior to transfer, a high-quality image can be provided without the transfer efficiency being reduced, even when the amount of toner used has been reduced. Further, depending on whether the image is the output image made up of text alone, the output image made up of a photo alone, or the image made of a combination of text and photo, the toner charge amount for ensuring high-quality output would be preferably changed in some cases. In such cases, the current (voltage) supplied to the transfer roller 7 or the current (voltage) supplied to the recording material charging section 91 is controlled depending on the charge amount of the toner image prior to transfer. When this control is provided, then a high-quality image is provided without the transfer efficiency being reduced.

Figure 4:
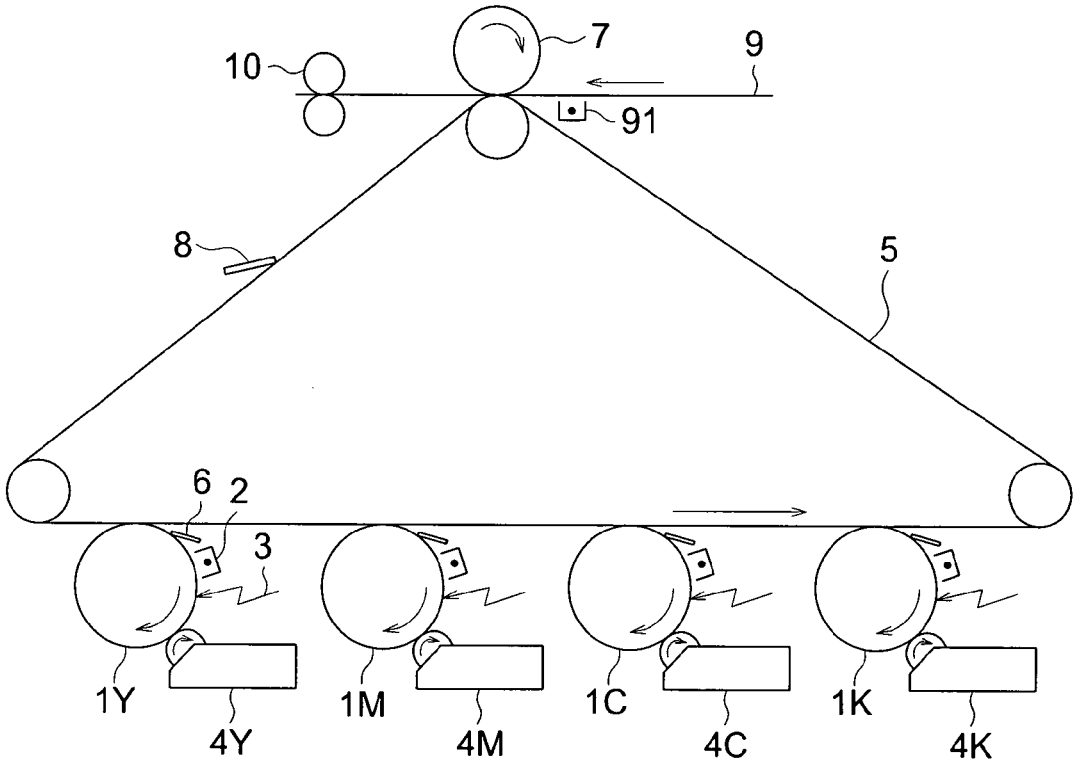
FIG. 4 is a diagram showing the schematic structure of the image forming apparatus as another embodiment of the present invention.

An image forming apparatus has been described, wherein four liquid developing devices 4Y, 4M, 4C and 4K are arranged around one photoconductor 1, as shown in FIG. 1. Similarly in the case of FIG. 1, the present invention is also applicable to the image forming apparatus wherein four photoconductors 1Y, 1M, 1C and 1K are arranged around the intermediate transfer member 5, and each photoconductor is provided with one liquid developing device, as shown in FIG. 4.

Figure 5:
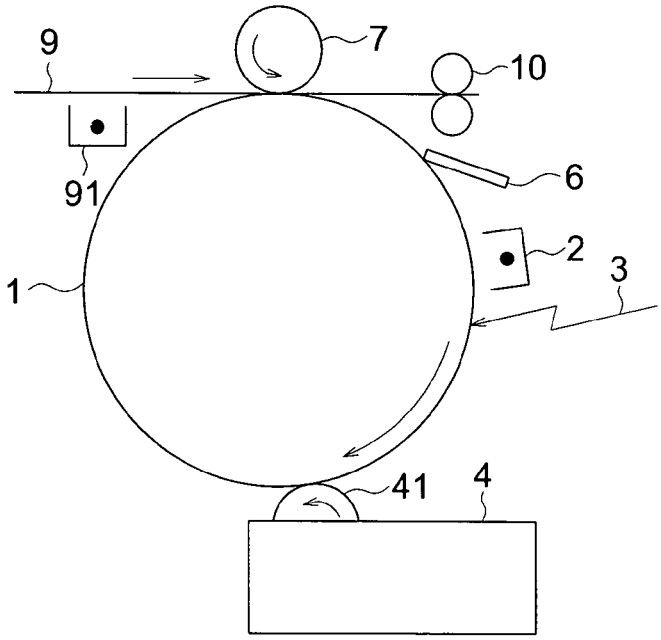
FIG. 5 is a diagram showing the schematic structure of the image forming apparatus as still another embodiment of the present invention.

FIG. 5 is a diagram representing the schematic structure of the image forming apparatus as another embodiment of the present invention. A charger 2, exposure device 3, liquid developing device 4, transfer roller 7, and photoconductor cleaning device 6 are sequentially arranged around the photoconductor 1 as an electrostatic latent image supporting member in the rotating direction indicated by an arrow. Unlike the image forming apparatus of FIG. 1, this is a single-color image forming apparatus equipped with one liquid developing device 4, without an intermediate transfer member being provided. Otherwise, the arrangement is the same as the image forming apparatus of FIG. 1.

The operation of the image forming apparatus in FIG. 5 is practically the same as that of the image forming apparatus of FIG. 1, except that the surface toner image of the photoconductor 1 is transferred to the recording material 9 directly not through the intermediate transfer member. To be more specific, the electrostatic latent image formed on the surface of the photoconductor 1 is developed by the liquid developing device 4, and a toner image is formed on the surface of the photoconductor 1. While linear pressure is applied to this toner image by the transfer roller 7, a bias is applied to toner image, and the image is transferred to the recording material 9. And the recording material 9 to which the toner image has been transferred is subjected to the process of fixing by the fixing device 10 at the end, whereby image outputting is completed.

As described above, even when the toner image on the surface of the photoconductor 1 is transferred directly to the recording material 9, the relationship between the charge amount of the toner image per unit are prior to transfer and the amount of charge to be applied to the recording material 9 required to provide 100% transfer is the same as that of the apparatus provided with the intermediate transfer member. The amount of toner and the amount of charge applied to the toner are adjusted depending on the kind of the recording material, and the amount of charge to be applied to the recording material 9 is adjusted depending on the charge amount of the toner image on the photoconductor 1, whereby the uniformity of the density in the solid portion can be ensured, and the transfer efficiency can be maximized. Thus, a high-quality image output can be provided regardless of the kind of the recording material 9.

EXAMPLE 1

Using the image forming apparatus of FIG. 1, the image forming conditions for three recording materials were set and controlled as shown in Table 1, and images were outputted to examine the transfer efficiency and the uniformity of solid density at this time. The necessary and sufficient amount of toner to get the uniform solid density was checked in each recording material in advance. It was revealed that the necessary and sufficient amount of toner was 1.5 g/m$^2$ for gloss coated paper, 2.0 g/m$^2$ for matte coated paper and 2.5 g/m$^2$ for non-coated paper (quality paper). The amount of the developer conveyed on the development roller 41 was adjusted to ensure supply of toner in this amount. In practice, this adjustment was made by adjusting the speed ratio θ of the regulating roller 45 and pump-up roller 43 to the development roller 41. The toner charge amount was adjusted by adjusting the current flowing into the development roller 41 from the corona charging device 46. This current was calculated by subtracting the current flowing to the casing of the corona charging device 46, from the current supplied from the power supply 16. A conductive NBR rubber roller was used as the intermediate transfer member 5 and transfer roller 7. If the current supplied to the transfer roller 7 is excessive, leakage will occur at the transfer nip and transfer efficiency will be reduced suddenly. The current was set to 150 μA the maximum current without allowing the leakage to occur.

The liquid developer used was made of the toner dispersed in the nonvolatile insulating carrier wherein this toner was formed by dispersing pigments in the resin in advance. Further, a small amount of dispersant was also added. The percentage of the toner in the liquid developer was 25% by mass. This was a high-viscosity liquid developer having a viscosity of 0.1 Pa·s at 25° C. The average particle diameter of toner was 2.5 μm.

The surface roughness of the recording material was obtained by measuring the ten-point average roughness Rz (JIS B 0633: 2001) by a surface roughness meter. The surface roughnesses are 2.3 μm for gloss coated paper, 4.8 μm for matte coated paper, and 12 μm for non-coated paper.

The transfer efficiency was evaluated under the following conditions. A two-color solid image made up of superimposed magenta and cyan colors was outputted. Assuming that the mass of toner formed on the intermediate transfer member 5 prior to transfer to the recording material 9 was A, and the mass of toner remaining on the intermediate transfer member 5 subsequent to transfer to the recording material 9 was B, transfer efficiency was calculated from the following formula:

$$\text{Transfer efficiency}[\%]=((A-B)/A)\times 100$$

The solid density uniformity was evaluated by visual observation of the output image.

As shown in Table 1, even when there was a great charge amount of the toner image on the intermediate transfer member 5, 100% transfer efficiency could be achieved by increasing the current applied to the corona charging device 91 as a recording material charging section. For eevely recording material, high transfer efficiency could be achieved without uniform solid density being deteriorated.

TABLE 1

| Kind of recording material | Amount of toner g/m$^2$ | Amount of developer conveyed g/m$^2$ | θ | Current of corona charging device for charging toner μA | Developer toner Q/M μC/g | Charge amount of toner image on intermediate transfer member μC/m$^2$ | Transfer roller current μA | Current of corona charging device for charging recording material μA | Transfer efficiency % | Solid density uniformity |
|---|---|---|---|---|---|---|---|---|---|---|
| Gloss coated paper | 1.5 | 6 | 1 | 180 | 400 | 600 | 150 | 0 | 100 | Good |
| | | | | | | | | 200 | 100 | Good |
| | | | | | | | | 400 | 100 | Good |
| Matte coated paper | 2 | 8 | 1.5 | 220 | 380 | 750 | 150 | 0 | 80 | Poor |
| | | | | | | | | 200 | 100 | Good |
| | | | | | | | | 400 | 100 | Good |
| Non-coated paper | 2.5 | 10 | 2 | 240 | 320 | 800 | 150 | 0 | 70 | Poor |
| | | | | | | | | 200 | 90 | Poor |
| | | | | | | | | 400 | 100 | Good |

Conditions where the same as those of Example 1. The amount of toner deposited was 1.5 g/m$^2$ in any recording material and transfer current was 150 μA, without adjusting the amount of toner deposited for each kind of the recording material. Other image forming conditions were also the same as those of the three recording materials. Table 2 shows the result. Although high transfer efficiency was achieved in all of the three recording materials, uniformity in solid density was inferior to that of Example 1 in the matte coated paper and non-coated paper.

TABLE 2

| Kind of recording material | Amount of toner g/m$^2$ | Amount of developer conveyed g/m$^2$ | θ | Current of corona charging device for charging toner μA | Developer toner Q/M μC/g | Amount of toner image charge on intermediate transfer member μC/m$^2$ | Transfer roller current μA | Current of corona charging device for charging recording material μA | Transfer efficiency % | Solid density uniformity |
|---|---|---|---|---|---|---|---|---|---|---|
| Gloss coated paper | 1.5 | 6 | 1 | 180 | 400 | 600 | 150 | 0 | 100 | Good |
| Matte coated paper | 1.5 | 6 | 1 | 180 | 400 | 600 | 150 | 0 | 100 | Fair |
| Non-coated paper | 1.5 | 6 | 1 | 180 | 400 | 600 | 150 | 0 | 100 | Poor |

What is claimed is:

1. An image forming apparatus, comprising: an image supporting member;

an image forming mechanism which is adapted to form an electrostatic latent image on the image supporting member;

a development section which is adapted to develop the electrostatic latent image formed on the image supporting member with a liquid developer including toner so as to form a toner image;

a transferring section which is adapted to transfer the toner image formed by the development section onto a recording material;

an input portion which is adapted to input a property of the recording material;

a toner charge amount control portion which is adapted to control an amount of a charge of the toner in the liquid developer depending on the property of the recording material inputted by the input portion before the electrostatic latent image is developed with the liquid developer;

a recording material charging section which is adapted to apply a charge to a surface of the recording material; and a recording material charge amount control portion which is adapted to control an amount of the charge to be applied to the recording material by the recording material charging section depending on the amount of the charge of the toner controlled by the toner charge amount control portion.

2. The image forming apparatus of claim 1, further comprising:

a toner amount control portion which is adapted to control an amount of toner of the toner image depending on the property of the recording material inputted by the input portion.

3. The image forming apparatus of claim 2, wherein the development section includes:

a developer supporting member which is adapted to support the liquid developer to develop the electrostatic latent image; and a supplying section which is adapted to supply the liquid developer to the developer supporting member, wherein the toner amount control portion controls an amount of toner of the toner image by controlling a supply amount of the liquid developer to be supplied by the supplying section.

4. The image forming apparatus of claim 3, wherein the supplying section includes:

a developer container;

a pump-up roller for pumping up the liquid developer in the liquid developer container; and a regulating roller for receiving the liquid developer from the pump-up roller and supplying the liquid developer to the developer supporting member, wherein the toner amount control portion controls a speed ratio between the pump-up roller and the regulating roller.

5. The image forming apparatus of claim 1, further comprising:

an intermediate transfer member to which the toner image formed on the image supporting member is transferred and which temporarily holds the toner image.

6. The image forming apparatus of claim 5, wherein the developing section includes a plurality of developing devices which are adapted to form a toner image of a plurality of colors, the developing devices sequentially form a plurality of toner images of different colors on the image supporting member, a plurality of the toner images are superimposed on the intermediate transfer member, and the superimposed toner image is transferred onto the recording material.

7. The image forming apparatus of claim 5, wherein a plurality of sets of the image supporting members, the image forming mechanisms and the development sections are provided to form a toner image of a plurality of colors on the intermediate transfer member, a plurality of toner images of different colors are formed on the image supporting members, the plurality of toner images are superimposed on the intermediate transfer member, and the superimposed toner image is transferred onto the recording material.

8. The image forming apparatus of claim 1, wherein the recording material charging section includes a corona charger.

9. The image forming apparatus of claim 1, wherein the input portion is provided on an operation panel for an operator to input a kind of the recording material.

10. The image forming apparatus of claim 1, wherein the input portion includes a detection section which is adapted to detect a roughness of the recording material.

11. The image forming apparatus of claim 1, further comprising:

a transfer current control section which is adapted to control a transfer current supplied by the transferring section depending on the property of the recording material inputted by the input portion.

12. A method of forming an image, comprising the steps of:

forming an electrostatic latent image on an image supporting member;

forming a toner image by developing the electrostatic latent image formed on the image supporting member with a liquid developer;

transferring the toner image onto a recording material;

judging a property of the recording material;

applying a charge to the toner, in the liquid developer depending on the judged property of the recording material before the electrostatic latent image is developed with the liquid developer; and applying a charge to the recording material depending on the judged property of the recording material.

* * * * *